United States Patent [19]

Shimizu

[11] Patent Number: 4,783,015

[45] Date of Patent: Nov. 8, 1988

[54] TOILET PAPER ROLL AND METHOD OF MANUFACTURE THEREOF

[75] Inventor: Akira Shimizu, Fuji, Japan

[73] Assignees: Shimizu Machinery Co., Ltd., Shizuoka; Hiroshi Genda, Tokyo, both of Japan

[21] Appl. No.: 77,922

[22] Filed: Jul. 27, 1987

[30] Foreign Application Priority Data

Aug. 27, 1986 [JP] Japan ..... 61-199028
Aug. 27, 1986 [JP] Japan ..... 61-129542[U]

[51] Int. Cl.[4] ..... B65H 18/20; B65H 18/28

[52] U.S. Cl. ..... 242/1; 242/66; 242/68.5

[58] Field of Search ..... 242/66, 65, 68.5, DIG. 3, 242/67.1 R, 67.2, 56 R, 56.2, 1

[56] References Cited

U.S. PATENT DOCUMENTS 610,339 9/1898 Atherton ..... 242/68.5 X
1,880,448 10/1932 Hickman ..... 242/68.5 X
1,882,012 10/1932 Hires ..... 242/68.5 X
3,823,887 7/1974 Gerstein ..... 242/DIG. 3 X
4,487,378 12/1984 Kobayashi ..... 242/67.1 R X

FOREIGN PATENT DOCUMENTS 2522011 11/1976 Fed. Rep. of Germany ..... 242/66
5443963 12/1979 Japan .

*Primary Examiner*—John M. Jillions
*Attorney, Agent, or Firm*—Armstrong, Nikaido, Marmelstein & Kubovcik

[57] ABSTRACT

Disclosed are a toilet paper roll which is devoid of a cardboard core and has a 2-layer structure comprising a hard core layer portion formed by tightly rolling up a material toilet paper on a temporary take-up core which is eventually removed and an outer layer portion formed continuous to the core layer portion by rolling up the toilet paper less tightly than the core layer portion, over or surrounding the core layer portion, and a method of manufacture of such toilet paper roll.

3 Claims, 1 Drawing Sheet

TOILET PAPER ROLL AND METHOD OF MANUFACTURE THEREOF

BACKGROUND OF THE INVENTION

The present invention relates to a toilet paper roll of such a structure as does not require a conventional cardboard tubular core, and also to a method of manufacturing such toilet paper rolls.

Conventionally, toilet paper rolls are produced by winding or taking-up a toilet paper material, typically crepe paper, on a tubular core usually of a cardboard having a diameter normally on the order of 4 cm, to a roll size on the order of 14 cm in outside diameter. Toilet paper rolls are also usually manufactured by taking-up toilet paper material of a relatively great width on an accordingly long core to provide a half-finished toilet paper roll and then cutting or slitting the half-finished paper roll to provide toilet paper rolls of a width as prescribed. For purposes of definiteness in description, "an intermediate product (of toilet paper rolls)" is herein termed to mean such half-finished toilet paper roll.

As stated above, toilet paper rolls usually have a cardboard tubular core. If they can be produced without the need of using such a cardboard core, then an advantage is obtained in that the cost of the cardboard core is eliminated and, the cost of the production of toilet paper rolls can be reduced accordingly. A further advantage which is also realizable in the case of toilet paper rolls devoid of a cardboard tubular core is obtained in the use of toilet paper rolls in public conveniences, namely such lavatories as installed or provided in various public places and buildings, which are sometimes inconvenienced by cardboard cores of toilet paper rolls having been thrown into toilet bowls. Cardboard cores can not be flushed away and give rise to clogging in the toilet devices and/or drainage system. This inconvenience can be avoided if toilet paper rolls do not have the cardboard core. Moreover, if the cardboard cores, the diameter of which is normally on the order of 4 cm as stated above is dispensed with, there will be produced a central open space in the toilet paper roll, and the central open space may then be partly filled with an additional taken-up portion of the toilet paper to increase the amount or length of paper per roll without any increase made in the outside diameter of paper rolls. In the case of such toilet paper rolls, assuming that the paper is consumed in a constant amount each time of use, the time before a single toilet paper roll is used up can be prolonged or the frequency of required replenishment of toilet paper rolls can be reduced. Also, the number of toilet paper rolls to be constantly kept in stock according to for example household needs can be greatly reduced to accordingly save the space required for the stock or storage of paper rolls.

Then, Japanese utility model publication No. 54-43963 discloses an invention relating to such a toilet paper roll in which the tubular cardboard core is eliminated to avoid high production costs and the inconvenience of clogging toilet drain systems and which is prevented from undergoing a deformation likely due to the absence of a cardboard core. According to the invention disclosed in this publication, a toilet paper roll is produced in a manner such that in rolling toilet paper material on a take-up core of a very small diameter by applying pressure to the toilet paper being taken-up, a change is imparted to the pressure application so that a core layer portion of the paper roll is relatively loosely formed, then an outer layer portion is relatively tightly formed over such relatively loosely rolled core layer portion, and upon completion of the rolling-up of paper, the take-up core is pulled out of the formed roll of paper, to provide a toilet paper roll devoid of a core.

While the toilet paper roll is used with a rollsupport shaft or bar of a toilet-roll holder inserted through its central hole formed after the removal of the take-up core, with the paper roll according to the invention of the patent publication in reference, the inner layers of paper close to the small-diameter take-up core are relatively loosely rolled up as stated above and are therefore prone to deformation after removal of the take-up core. Thus when attempting to insert a roll support bar of the toilet roll holder increasingly deep into the hole through the paper roll, the support bar is moved in a manner which tends to peel off the innermost layer forming the wall of the hole, and it becomes difficult or troublesome or it requires a particular care to be exerted to smoothly insert the roll support bar.

Also, toilet paper rolls are produced and commercially distributed in mass, and they are not necessarily always handled carefully. If they are subjected to shock during handling, they tend to undergo deformation in their respective core layer portions if the core portions are loosely rolled up as above.

Then, with respect to devices for producing toilet paper rolls, conventional devices involve various problems in automatically continuously carrying out all of the steps of supplying cardboard take-up cores which are indespensably used in taking-up toilet paper material, of rolling-up a toilet paper stock on the take-up cardboard core, of cutting the paper after completion of the taking-up of the prescribed length of paper to provide an intermediate product of toilet paper rolls and of taking out the intermediate product, being a half-finished toilet paper roll.

SUMMARY OF THE INVENTION

In view of the above, it is a first object of the present invention to provide such a toilet paper roll which is devoid of a cardboard core but has a core layer portion and yet is not likely to undergo deformation in its core layer portion and which is possessed of the above-indicated various advantages attributable to the absence of the cardboard core in the paper roll.

A second object of the invention is to provide a method of automatically continuously manufacturing such toilet paper rolls.

As before stated, in the manufacture of toilet paper rolls, initially a toilet paper material of a relatively great width is rolled up on a take-up core to provide an intermediate product of a relatively great length corresponding to the width of the toilet paper material, and then the intermediate product is slit to provide product toilet paper rolls having the prescribed width suitable for use. According to the present invention, the slitting of the intermediate product may be carried out by any of known per se methods, and the invention will be described mainly in connection with the intermediate product of toilet paper rolls devoid of a core and a method of the production of such intermediate product.

To attain the above first object of the invention, the toilet paper roll according to the invention avoids the use of a cardboard core and comprises a core layer portion formed by relatively tightly rolling up the prescribed initial length of toilet paper and an outer layer portion formed over the core layer portion, continuously from the core layer portion, by relatively loosely taking up a successive length portion of the toilet paper. The core layer portion is comparable to the cardboard core used with conventional intermediate products and toilet paper rolls.

To attain the above second object, the invention provides such a method of automatically continuously manufacturing toilet paper rolls which comprises the following steps (a) to (e):

(a) the step of causing a temporary take-up core to be supported on peripheral surfaces of a first and a second upper support rollers which are rotated in a same direction of rotation with space maintained between the peripheral surfaces thereof and which can be retractably brought to be close to each other, (b) the step of feeding a material toilet paper along an upper peripheral portion of the first upper support roller and, with pressure applied to the paper being fed, taking up the prescribed initial length portion of the paper on the take-up core to form a tightly rolled-up "hard" core layer portion, (c) the step of broadening the space between the two upper support rollers to allow the above formed "hard" core layer portion to move downwardly through the broadened space between the two rollers, causing the core layer portion to be supported by the two upper support rollers and a lower support roller disposed below the former rollers, and continuously taking up the paper to form an outer layer portion which is less tightly rolled-up than the core layer portion, (d) the step of accelerating the rotation of each of the first upper support roller and the lower support roller to cause to be cut the paper being continuously fed and taken up and to form an intermediate product, and (e) the step of lowering the lower support roller and taking out the above formed intermediate product.

The toilet paper roll according to the present invention is characterized in that it has a two layer structure comprising a hard core layer which is relatively tightly formed and an outer layer which is relatively loosely formed over the core layer and in that although it is devoid of a tubular core normally of cardboard, it has a core layer portion comparable to the tubular cardboard core but formed of the toilet paper itself.

Preferably the core layer portion, which compares to the cardboard core in conventional toilet paper rolls, has a layer thickness within a range of from about 5 to 10 mm, and a hardness which is comparable to or may be more or less than the hardness of cardboard cores in conventional toilet paper rolls.

In greater detail, the following conditions should necessarily be answered, having regard to the formation of the core layer portion and the hardness thereof.

First, after the formation of an intermediate product by rolling up a material toilet paper of a great width or breadth on a take-up core, the core layer portion can permit the take-up core to be pulled out of the paper roll body and does not permit the hole to become deformed after the removal of the take-up core.

Second, while after the removal of the take-up core as above the intermediate product is cut or slit to produce toilet paper rolls of the prescribed width, the hole through the intermediate product does not undergo collapse or deformation during and through a cutting or slitting operation.

Third, while toilet paper roll products as produced above are then packaged, transported, distributed, retailed and finally consumed, the core layer portion should be able to maintain its original condition all through the operations to be then performed.

The outer layer or outer layer portion that is relatively loosely formed about the core portion or core layer portion may have the same hardness or tightness as conventional toilet paper rolls.

A device for manufacturing toilet paper rolls or, more directly, an intermediate product of toilet paper rolls according to the present invention preferably has the following structural features and comprises:

(1) a first and a second upper support rollers which support and drive a take-up core to rotate on peripheral surfaces thereof and which are adjustably spaced from each other, (2) a pressing roller for applying pressure to the take-up core supported on peripheral surfaces of the two upper support rollers, (3) a device for supplying take-up cores one at a time from the side of the second upper support roller, and (4) a lower support roller which is mounted below the upper support rollers and adapted for movement toward and away from the upper support rollers.

The upper support rollers are driven rollers of an identical outside diameter, and while the shaft of one of the two rollers, namely the second roller, is not movable but is stationary, the other roller or the first roller is movable parallel to the stationary shaft of the second roller to change the space between the peripheral surfaces of the two rollers.

The first roller or movable roller is supported at an end portion of a lever so that by swinging or pivotally moving the lever, the space between the two rollers is adjusted, the lever being driven by a hydraulic cylinder, a pneumatic cylinder or an electric motor.

The pressing roller is supported by a lever having its pivot point on the shaft of the movable roller or the first roller, and this lever is driven by a cylinder to bring the pressing roller closer to or remote from the peripheral surfaces of the two upper support rollers. In the condition of the pressing roller being retracted from the upper support rollers, take-up cores are supplied onto peripheral surfaces of the support rollers one at time, and in the condition of the pressing roller being brought closer to the support rollers, this roller can press the take-up core against the peripheral surfaces of the two support rollers.

On the side of the second upper support roller, namely the support roller the shaft of which is stationary, there is disposed a guide plate, and by a suitable supply device such as a cylinder device, take-up cores are supplied and guided on the guide plate, one at a time, into a space between the peripheral surfaces of the two upper support rollers, and the or each take-up core is supported in the space and driven to rotate at the prescribed velocity to take up an initial length portion of the material toilet paper and form a core layer portion of an intermediate product, namely a half-finished paper roll.

The lower support roller, which is disposed below the upper support rollers and which can be driven to come closer to or be retracted from a lower peripheral portion of each of the upper support rollers, is supported at a free end portion of a lever. By causing this lever to swing by a cylinder, the lower support roller can be raised in position toward the upper support rollers so that by the three rollers, namely the two upper support rollers and the lower support roller, the core layer portion can be received, supported and further processed to an intermediate product by taking a further prescribed length portion of the material toilet paper continuously on the core layer portion. When an intermediate product is produced as above by relatively loosely forming the outer layer portion between underside portions of the peripheral surfaces of the two upper support rollers and an upper portion of the peripheral surface of the lower support roller, the lower support roller is retracted to a lower position, whereby the intermediate product can be taken out onto a guide plate.

In a succeeding operation step, the above produced intermediate product is cut by an appropriate slitter to product toilet paper rolls of the prescribed width.

Using a machine or device structured as above, it is feasible to continuously produce intermediate products of toilet paper rolls by forming a relatively tightly rolled-up core portion by cooperation of two upper support rollers and one pressing roller, and then continuously forming a relatively loosely rolled-up outer layer portion by the cooperation of the two upper support rollers and one lower support roller.

The toilet paper roll according to the present invention has a core layer portion which is so tightly formed in the piled condition of paper layers that it can almost compare to a cardboard core in conventional toilet paper rolls, therefore although it does not have a particular core member such as a cardboard tubular core, it can well maintain an original roll shape even if it would be relatively roughly handled. Thus, in addition to that it has a same commercial value as conventional toilet paper rolls, it can bring about an advantage such that in use, it permits to take place a smooth insertion of the supporting shaft of a toilet-roll holder through its central hole.

Also, the toilet paper roll according to the invention being without a conventional tubular cardboard core, it can be produced at a lower cost in comparison to conventional toilet rolls having such core member. According to the invention, the need is effectively eliminated of separately and particularly disposing of the toilet roll core upon consumption of a toilet paper roll, as well as the risk of troubles of toilet systems being caused to be clogged which are likely particularly in public lavatories when a cardboard toilet roll core of conventional toilet paper rolls is thrown into the toilet bowl.

Further, according to the invention, the toilet paper roll can have a greater length of rolled-up paper in comparison to conventional toilet paper rolls having the cardboard core tube, of an identical roll size or outside diameter. Therefore, providing toilet paper rolls are consumed in constant lengths of paper each time, the time before a single toilet paper roll is used up can be longer or the frequency at which a fresh toilet paper roll is to be replenished can be reduced. This leads to that the number of toilet rolls to be kept in stock as one of household necessities can be reduced.

Industrially and/or commercially, then, toilet paper rolls having a same roll size but having a greater length of paper per roll, according to the invention, are advantageous over conventional toilet paper rolls having a particular core member in that containers for toilet paper rolls, usually cardboard boxes, of a same size or capacity can contain a greater amount of toilet paper, whereby the cost of storage and transportation per unitary amount or length of the toilet paper can be curtailed.

According to the method of manufacture of toilet paper rolls of the present invention, it is feasible to continuously and highly efficiently manufacture toilet paper rolls which, as stated above, are devoid of a particular core member separately of the toilet paper itself and which are advantageous in various respects as stated before, and it therefore is possible to enhance the production efficiency and curtail the production cost in the manufacture of toilet paper rolls.

BRIEF DESCRIPTION OF THE DRAWINGS

FIGS. 1 and 2 of the accompanying drawings together illustrate an embodiment of the technical concept of the present invention, in which:

FIG. 1 shows a side elevational view of a toilet paper roll according to the invention; and FIG. 2 shows a schematic side elevation, taken for an illustration of the structure of a device for carrying out a continuous rolling up of a material toilet paper to provide an intermediate product of toilet paper rolls for the manufacture of the toilet paper roll shown in FIG. 1.

DESCRIPTION OF THE PREFERRED EMBODIMENT

Figure 2:
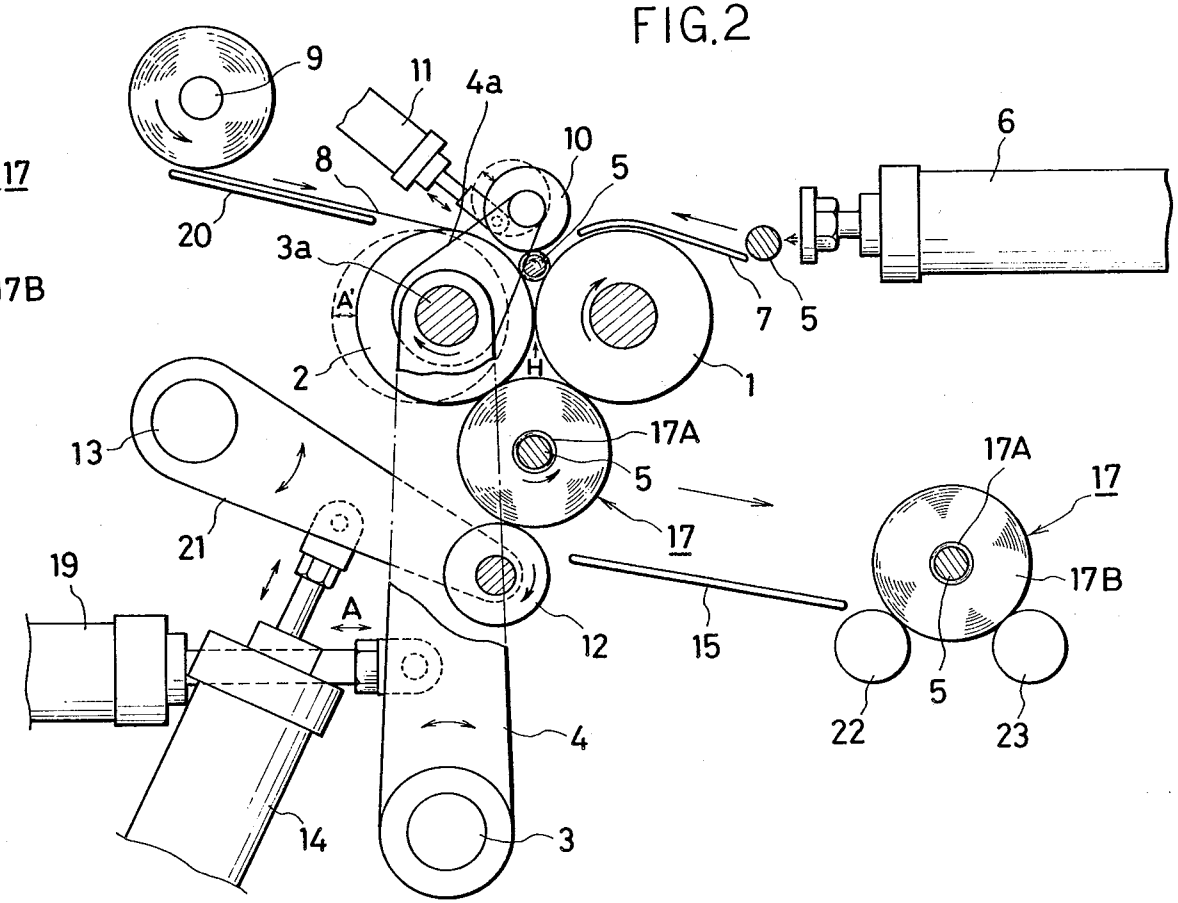

With reference to FIG. 2, this shows a preferred machine or device for continuously rolling up toilet paper for the carrying out of the method of the present invention, and this device has the following structure and arrangements.

A first upper support roller 2 and a second upper support roller 1, which are driven to rotate at a constant velocity in an identical direction as shown by arrows, are disposed with space or a distance maintained between peripheral surfaces thereof, which space or distance is so small that in FIG. 2 the two rollers are seen to be in contact with each other, but in fact the rollers should be appreciably spaced from each other as indicated by an arrow H so that these rollers can rotate in a same or an identical direction. The first upper support roller 2 is supported by a shaft 3*a* to a free end portion of a lever or an arm 4 which can swing or pivot about a fulcrum comprising a shaft 3 as shown by a bilateral arrow, and the arm 4 is driven by a cylinder 19 operable in directions shown by a bidirectional arrow A, to move the prescribed distance in the directions shown by a bidirectional arrow A' to adjust the distance between the peripheral surfaces of the two rollers 1 and 2, each of which comprises a friction roller, for example a rubber roller.

At a side of the device closer to the second upper support roller 1, a cylinder 6 is mounted for supplying take-up cores 5 one at a time onto upper portions of the peripheral surfaces of the upper support rollers 1 and 2. As pushed by the cylinder 6 and guided on a guide plate 7, each take-up core 5 is dropped into a space formed between peripheral surface portions of the rollers 1 and 2. The first upper support roller 2 is for feeding a toilet paper material or toilet paper stock 8 of a certain great width, and the toilet paper 8 led from a roll 9 of the toilet paper and guided on a guide plate 20 is fed onto an upper peripheral surface portion of the first upper support roller 2.

To the above-mentioned free end portion of the arm 4 for supporting the first support roller 2, a lever or an arm 4*a* is mounted to swing or pivot with the shaft 3*a* of the roller 2 as the center of the pivotal motion, and by this arm 4a a pressing roller 10 is supported. The arm 4a is provided with a cylinder 11, by which the pressing roller 10 can be brought closer to upper peripheral portions of the upper rollers 1 and 2 as shown by a solid line or be retracted to the position shown by a broken line or phantom line, so that the pressure at which the take-up core 5 is pressed against the rollers 1 and 2 can be adjusted. The pressing roller 10 comprises a friction roller, for example a rubber roller.

Below the upper support rollers 1 and 2, a lower support roller 12 is disposed, which is mounted on a free end portion of a lever or an arm 21 adapted to swing up and down about a fulcrum comprising a shaft 13. A pressure cylinder 14 is connected to the arm 21 so that by operating the cylinder 14, the arm 21 pivots up and down and the lower support roller 12 can be raised and lowered in position. The roller 12 may comprise a driven rubber roller.

Close to the lower support roller 12, there is disposed a guide plate 15 for receiving an intermediate product of toilet paper rolls to be taken out, namely a half-finished toilet paper roll 17 and close to the remote end of the guide plate 15 away from the roller 12, rollers 22 and 23 are provided for thereon receiving the toilet paper intermediate product 17.

While the upper support rollers 1 and 2 and the lower support roller 12 are all driven to rotate at the prescribed velocities in their respective directions of rotation shown by arrows, the first upper roller 2 and the lower roller 12 are capable of being accelerated in their respective rotation to automatically cut the toilet paper 8 in completing the formation of each toilet paper roll intermediate product. The toilet paper 8 is provided with transverse weakening lines, for example perforation lines, at prescribed intervals in the longitudinal direction of the paper, and when the tension applied to the paper 8 being rolled up is raised, it can be readily cut.

Now, a description will be entered into the steps of manufacturing an intermediate product of toilet paper rolls or toilet roll intermediate product according to the present invention, using the above described device or machine.

Initially, a take-up core 5 is forcibly dropped by the cylinder 6 into the space between upper peripheral portions of the upper support rollers 1 and 2 while these rollers are rotated at the prescribed velocity. As the take-up core 5 is rotated at the prescribed speed, a free end or leading end portion of the toilet paper 8 preparatively fed from the roll 9 thereof along an upper peripheral portion of the first upper support roller 2 becomes taken up on the take-up core 5, and with this core 5 relatively strongly pressed from above by the pressing roller 10, the prescribed length of the paper 8 enough to form a core layer portion 17A of a toilet roll intermediate product 17 to be formed is tightly taken up on the core 5.

Then, by operating the arm 4 supporting the first upper support roller 2, this roller 2 is moved from its position shown by the solid line toward the left in the directions shown by the bilateral arrow A' to the position shown by the broken or phantom line to broaden the space between the peripheral surfaces of the two upper rollers 1 and 2, and the core layer portion 17A formed on the take-up core 5 is automatically transferred, together with the take-up core 5, into a space formed among a lower peripheral surface portion of each of the upper rollers 1 and 2 and an upper peripheral surface portion of the lower support roller 12.

Figure 1:
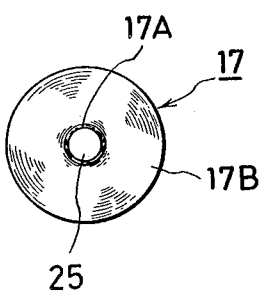

Then, while rolling-up of the toilet paper 8 is continued, the paper 8 is now less tightly taken up than the core layer portion 17A with a pressure applied by the lower support roller 12 supported by the lever 21 which is upwardly pivoted, to thereby form the outer layer portion 17B of an intemediate product 17 to be produced. Upon completion of the rolling-up of the outer layer portion 17B of the prescribed length, the rotation of the first upper roller 2 and that of the lower support roller 12 are accelerated, upon which the toilet paper 8 becomes automatically cut, and then the lower support roller 12 is retracted or lowered to permit the intermediate product 17 thus formed to be taken out onto and guided on the guide plate 15, followed then by removal of the take-up core 5. After removal of the take-up core 5, the intermediate product 17 presents a view as shown in FIG. 1, while a same view as this will be presented also by product toilet paper rolls which can be provided by slitting the intermediate product 17 removed of the take-up core 5 in any of the manners known per se.

At the time when the cutting of paper 8 takes place as stated above, a second one of the take-up cores 5 has already been placed on upper peripheral portions of upper rollers 1 and 2 by the cylinder 6 of the take-up core feeding device (the cylinder 6 alone is shown in FIG. 2), and in a same manner as above, on this second take-up core 5 the leading end portion of the paper 8 is taken up. Thereafter, the above steps are repeated to continuously and automatically produce toilet roll intermediate products 17.

As stated above, by lowering the lever 21 by operating the cylinder 14, the intermediate product 17 formed on or around the take-up core 5 is allowed to be transferred onto the guide plate 15 and then onto a pair of driven rollers 22 and 23. Then, after the take-up core 5 is withdrawn from the intermediate product 17, the latter is subjected to cutting by an ordinary slitter into the prescribed length portions to accomplish the production of final toilet paper rolls.

The core layer portion 17A which is formed by taking up the toilet paper on the temporary take-up core 5 while the paper is pressed by the pressing roller 10 against upper peripheral surface portions of the support rollers 1 and 2 as stated above has a relatively high hardness comparable to the hardness of cardboard cores in conventional toilet paper rolls, while the outer layer portion 17B which is formed while it is supported from below by the lower support roller 12 and in contact with lower peripheral surface portions of the upper support rollers 1 and 2 has a lower hardness or tightness than the core layer portion 17A.

That is to say, the toilet roll intermediate product and accordingly the toilet paper roll in accordance with the present invention has a 2-layer structure comprising a relatively tightly formed core layer portion 17A and a relatively loosely formed outer layer portion 17B, and its circular central hole 25 in the center of the core layer portion 17A is formed as a result of removal of the temporary take-up core 5.

The core layer 17A comprises an appropriate initial length portion of the toilet paper 8 which is tightly rolled up by the function of the pressing roller 10 on or around the take-up core 5 of a small outside diameter as stated above, and the outer layer 17B comprises a succeeding length portion of the paper 8 which is less tightly rolled up than the core layer, surrounding the core layer.

As stated above, with the intermediate product 17 and accordingly the toilet paper rolls of the invention, the core layer 17A is so formed as to have a hardness comparable to the hardness of a cardboard tubular core had with conventional toilet paper rolls, so that the take-up core 5 can be taken out of the toilet paper roll 17 with ease and without any deformation caused to the innermost layer or layers of paper forming the wall of the central hole 25.

Also as stated before, with the toilet paper roll manufactured according to the present invention, although it is devoid of a cardboard or any other core, it has a very densely formed core layer portion, so that it can hardly undergo a deformation particularly about the central hole thereof and, in use, readily permits the support shaft or bar of a toilet-roll holder to be inserted through the hole.

According to the method of the invention, toilet paper is rolled up with the temporary take-up core 5 supported on upper peripheral surface portions of upper support rollers 1 and 2 and with the core 5 pressed against the rollers 1 and 2 by the pressing roller 10, so that the core layer portion 17A can be highly tightly or densely formed on the take-up core 5. The core layer portion 17A formed by taking up a toilet paper material on the take-up core, which may be called an unfinished or starting product of the intermediate product 17, is transferred below the upper support rollers 1 and 2, and surrounding this core layer portion 17A, the toilet paper is further rolled up relatively loosely between the lower support roller 12 and the two upper support rollers 1 and 2 to form the outer layer portion 17B to finally obtain the finished intermediate product 17 of toilet paper rolls. Thus, according to the method of the present invention, it is feasible to continuously and automatically manufacture intermediate products 17 and accordingly produce toilet paper rolls.

The device or machine for carrying out the method of the invention essentially comprises upper support rollers 1 and 2, a pressing roller 10 disposed above upper peripheral surfaces of the rollers 1 and 2, and a lower support roller 12 disposed below lower peripheral surfaces of the rollers 1 and 2, and it is compact in the overall structure.

I claim:

1. A toilet paper roll comprising a core layer portion having a central circular hole and an outer layer portion continuous to said core layer portion, said core layer portion being formed tightly and having a hardness sufficient to resist deformation of said central hole during transportation and handling of said toilet paper roll to thereby maintain said central hole in an open condition permitting insertion of a support shaft of a toilet roll holder and said outer layer portion being formed less tightly than said core layer portion over said core layer portion.

2. A toilet paper roll as claimed in claim 1, where said core layer portion has a layer thickness within a range of from 5 to 10 mm.

3. A toilet paper roll as claimed in claim 1, further including a removable take-up core internally of said core layer portion and said core layer portion is formed on said take-up core.

* * * * *